US007296624B2

(12) United States Patent
Rodet et al.

(10) Patent No.: US 7,296,624 B2
(45) Date of Patent: Nov. 20, 2007

(54) PRESSURE CONTROL APPARATUS AND METHOD

(75) Inventors: Vincent F. E. Rodet, Houston, TX (US); Ian S. Murley, Holywood (IE); Samuel Tocalino, Houston, TX (US); Matthe Contant, Eindhoven (NL)

(73) Assignee: Schlumberger Technology Corporation, Sugar Land, TX (US)

( * ) Notice: Subject to any disclaimer, the term of this patent is extended or adjusted under 35 U.S.C. 154(b) by 283 days.

(21) Appl. No.: 10/905,713

(22) Filed: Jan. 18, 2005

(65) Prior Publication Data

US 2005/0092488 A1 May 5, 2005

Related U.S. Application Data

(63) Continuation-in-part of application No. 10/760,854, filed on Jan. 19, 2004, now Pat. No. 7,128,152, which is a continuation-in-part of application No. 10/442,783, filed on May 21, 2003, now Pat. No. 7,128,160.

(60) Provisional application No. 60/537,644, filed on Jan. 19, 2004.

(51) Int. Cl.
*E21B 43/04* (2006.01)

(52) U.S. Cl. ..... 166/278; 166/51; 166/319

(58) Field of Classification Search ..... 166/278, 166/373, 374, 376, 381, 386, 51, 53, 316, 166/317, 319, 320, 321, 323, 332.1
See application file for complete search history.

(56) References Cited

U.S. PATENT DOCUMENTS 3,208,355 A * 9/1965 Baker et al. ..... 91/533
3,999,608 A 12/1976 Smith
4,428,428 A * 1/1984 Smyrl et al. ..... 166/278
4,522,264 A 6/1985 McNeer
4,796,699 A * 1/1989 Upchurch ..... 166/250.17

(Continued)

FOREIGN PATENT DOCUMENTS

GB 2252347 A 8/1992

(Continued)

OTHER PUBLICATIONS

Search report by British Patent Office dated Apr. 11, 2005, for GB0501082.2.

*Primary Examiner*—Frank Tsay
(74) *Attorney, Agent, or Firm*—Robert Van Someren; Bryan P. Galloway; Tim Curington

(57) ABSTRACT

Pressure control in an isolated lower wellbore annulus, defined by a conduit sealably positioned within an isolated lower wellbore segment, is achieved while gravel packing by sensing the pressure within the isolated lower annulus while gravel packing and admitting fluid from the isolated lower annulus into the conduit at one or more discrete locations along the conduit when the sensed pressure corresponds to one or more threshold pressure conditions. The annulus pressure is sensed while gravel packing using a pressure-sensitive device disposed in the annulus, e.g., positioned by the conduit at a high-pressure location. The pressure-sensitive device actuates one or more valves carried along the conduit to admit fluid from the annulus into the conduit at one or more of the discrete locations, and thereby control the pressure in the isolated lower annulus.

17 Claims, 5 Drawing Sheets

U.S. PATENT DOCUMENTS 4,915,168 A * 4/1990 Upchurch ..... 166/250.15
4,932,474 A 6/1990 Schroeder, Jr.
5,069,280 A * 12/1991 McKee et al. ..... 166/278
5,411,097 A * 5/1995 Manke et al. ..... 166/324
5,676,208 A * 10/1997 Finley ..... 166/278
5,819,853 A * 10/1998 Patel ..... 166/373
5,819,854 A * 10/1998 Doane et al. ..... 166/373
6,021,095 A * 2/2000 Tubel et al. ..... 367/82
6,237,687 B1 * 5/2001 Barbee et al. ..... 166/278
6,311,772 B1 11/2001 Myhre et al.
6,386,289 B1 * 5/2002 Patel ..... 166/325
6,622,794 B2 * 9/2003 Zisk, Jr. ..... 166/373
6,640,897 B1 11/2003 Altman et al.
6,644,408 B2 11/2003 Ives
6,644,412 B2 * 11/2003 Bode et al. ..... 166/373
6,675,891 B2 * 1/2004 Hailey et al. ..... 166/228
6,786,285 B2 * 9/2004 Johnson et al. ..... 166/370
6,857,475 B2 * 2/2005 Johnson ..... 166/278
7,128,152 B2 * 10/2006 Anyan et al. ..... 166/278
7,128,160 B2 * 10/2006 Anyan et al. ..... 166/374
2002/0108755 A1 * 8/2002 Zisk, Jr. ..... 166/369
2002/0157837 A1 * 10/2002 Bode et al. ..... 166/373
2002/0189815 A1 * 12/2002 Johnson et al. ..... 166/373
2003/0066651 A1 * 4/2003 Johnson ..... 166/369
2003/0070809 A1 * 4/2003 Schultz et al. ..... 166/278
2003/0075324 A1 4/2003 Dusterhoft et al.
2003/0075325 A1 4/2003 Dusterhoft et al.
2003/0111224 A1 * 6/2003 Hailey et al. ..... 166/278
2003/0221829 A1 * 12/2003 Patel et al. ..... 166/278
2004/0154806 A1 * 8/2004 Bode et al. ..... 166/373
2004/0231853 A1 * 11/2004 Anyan et al. ..... 166/373

FOREIGN PATENT DOCUMENTS

GB 2383358 A 6/2003
WO WO 00/17482 A1 3/2000

* cited by examiner

PRESSURE CONTROL APPARATUS AND METHOD

CROSS-REFERENCE TO RELATED APPLICATIONS

This application claims priority to now abandoned provisional U.S. patent application Ser. No. 60/537,644 filed on Jan. 19, 2004, and is a continuation-in-part of Ser. No. 10/760,854 filed Jan. 19, 2004 now U.S. Pat. No. 7,128,152 issued on Oct. 31, 2006, which is a continuation-in-part of Ser. No. 10/442,783 filed May 21, 2003, now U.S. Pat. No. 7,128,160 issued on Oct. 31, 2006.

BACKGROUND OF THE INVENTION

1. Field of the Invention

The present invention relates to downhole tools used in subsurface well completion pumping operations, and particularly to tools used to enhance the effectiveness of gravel pack operations.

2. The Related Art

Gravel packing is a method commonly used to complete a well in which the producing formations are loosely or poorly consolidated. In such formations, small particulates referred to as "fines" (e.g., formation sand) may be produced along with the desired formation fluids. This leads to several problems such as clogging the production flowpath, erosion of the wellbore, and damage to expensive completion equipment. Production of fines can be reduced substantially using a steel wellbore screen in conjunction with particles sized to prevent passage of fines such as sand through the screen. Such particles, referred to as "gravel," are pumped as gravel slurry into an annular region between the wellbore and the screen. The gravel, if properly packed, forms a barrier to prevent the fines from entering the screen, but allows the formation fluid to pass freely therethrough and be produced.

A common problem with gravel packing is the presence of voids in the gravel pack. Voids are often created when the carrier fluid used to convey the gravel is lost or "leaks off" too quickly. The carrier fluid may be lost either by passing into the formation or by passing through the screen where it is collected by the end portion of a service tool used in gravel pack applications, commonly known as a wash pipe, and returned to surface. It is expected and necessary for dehydration to occur at some desired rate to allow the gravel to be deposited in the desired location. However, when the gravel slurry dehydrates too quickly, the gravel can settle out and form a "bridge" whereby it blocks the flow of slurry beyond that point, even though there may be void areas beneath or beyond it. This can defeat the purpose of the gravel pack since the absence of gravel in the voids allows fines to be produced through those voids.

Another problem common to gravel packing horizontal wells is the sudden rise in pressure within the wellbore when the initial wave of gravel, the "alpha wave," reaches the far end or "toe" of the wellbore. The return or "beta wave" carries gravel back up the wellbore, filling the upper portion left unfilled by the alpha wave. As the beta wave progresses up the wellbore, the pressure in the wellbore increases because of frictional resistance to the flow of the carrier fluid. The carrier fluid not lost to the formation conventionally must flow to the toe region because the wash pipe terminates in that region. When the slurry reaches the upper end of the beta wave, the carrier fluid must travel the distance to the toe region in the small annular space between the screen and the wash pipe. As this distance increases, the friction pressure increases, causing the wellbore pressure to increase.

The increased pressure can cause early termination of the gravel pack operation because of the risk that the wellbore pressure can rise above the formation fracture pressure, causing damage to the formation and leading to a bridge at the fracture. Thus, gravel pack operations are typically terminated when the wellbore pressure approaches the formation fracture pressure. Such early termination can lead to an incomplete packing of the wellbore and leave undesirable voids in the gravel pack. The only viable alternative is to redesign the gravel pack, and bear the attendant increases in time and expense, when the annulus pressure is expected to approach the formation fracture pressure.

Thus, a need exists to control the pressure in the wellbore resulting from progression of the carrier fluid beta wave. More particularly, a need exists for maintaining the annulus pressure below the formation's intrinsic fracture pressure on a real-time basis. Additionally, such pressure control should be compatible with subsequent fluid pumping/flow operations that typically following gravel packing.

SUMMARY OF THE INVENTION

In one aspect, the present invention provides an apparatus for controlling the pressure in an isolated lower wellbore annulus while gravel packing. The isolated lower annulus is defined by a conduit sealably positioned within an isolated lower wellbore segment. The inventive apparatus includes a plurality of valves carried by the conduit at discrete locations for selectively admitting fluid from the isolated lower annulus into the conduit at the discrete locations. The apparatus further includes a pressure-sensitive device carried by the conduit independently of the valves for sensing the pressure within the isolated lower annulus while gravel packing, and for actuating one of more of the valves when the sensed pressure corresponds to one or more threshold pressure conditions so as to admit fluid from the isolated lower annulus into the conduit and thereby control the pressure within the isolated lower annulus while gravel packing.

In particular embodiments of the inventive apparatus, the conduit includes a wash pipe sealably positioned within a wellbore packer assembly having a tubular wellbore screen depending therefrom. The wash pipe is positioned within the screen such that the screen divides the lower wellbore annulus into an inner lower annulus and an outer lower annulus. The wash pipe may include a crossover portion for delivering fluid to the outer lower annulus.

In particular embodiments of the inventive apparatus, each of the valves includes a valve body carried within the conduit. The valve body is equipped with a first port for admitting fluid from the isolated lower annulus to the conduit. A piston is slidably disposed in a chamber of the valve body and is movable from a position closing the first port to a position opening the first port upon actuation of the piston by the pressure-sensitive device.

In particular embodiments of the inventive apparatus, the piston has a flanged portion disposed for slidable movement within an enlarged portion of the valve body chamber. The flanged piston portion divides the enlarged chamber portion into first and second enlarged chambers. The valve body of such embodiments is equipped with a second port for admitting fluid pressure from the isolated lower wellbore annulus to the first enlarged valve chamber, urging the piston to the position opening the first port. Each of the valves further includes a flow control device moveable between positions opening and closing the second port upon actuation of the flow control device by the pressure-sensitive device.

Each of the valves according to the inventive apparatus may further include a check valve carried in the first port thereof to ensure fluid flows through the first port in one direction: from the isolated lower annulus to the conduit. The check valve may include a flapper valve having one or more pivotally mounted plates.

In particular embodiments of the inventive apparatus, the second enlarged chamber of the valve body includes a burn chamber housing a propellant and an igniter system for generating pressure for urging the piston to the position closing the first port.

In particular embodiments of the inventive apparatus, the pressure-sensitive device is carried by the wash pipe such that the pressure-sensitive device is positioned adjacent the wellbore packer assembly, e.g., under the first section of the screen. The pressure-sensitive device may include a pressure transducer and a controller. In such embodiments, the pressure-sensitive device actuates one or more valves by transmitting one or more actuation signals output from the controller. The one or more actuation signals may be transmitted wirelessly or by a conductor (e.g., using electricity or light as a medium) extending between the controller and the valves. The conductor may include one or more insulated wires carried along the wash pipe.

In another aspect, the present invention provides a valve for use in a conduit disposed in a wellbore while gravel packing an isolated lower annulus of the wellbore. The inventive valve includes a valve body adapted for carriage within the conduit. The valve body has a first port for admitting fluid from the isolated lower annulus into the conduit, a second port for admitting fluid pressure from the isolated lower annulus into the valve body, and a chamber. A piston is slidably disposed in the valve body chamber and movable between positions closing and opening the first port. The second port admits fluid pressure from the isolated lower annulus to the valve body chamber to urge the piston to the position opening the first port. The inventive valve further includes a closure mechanism for closing the first port. Particular embodiments of the inventive valve further include a flow control device selectively moveable between positions opening and closing the second port.

The valve closure mechanism may include a check valve carried in the first port to close the first port against fluid flow from the conduit to the isolated lower annulus. The check valve may include a flapper valve having one or more pivotally mounted plates.

In particular embodiments of the inventive valve, the piston has a flanged portion disposed for slidable movement within an enlarged portion of the valve body chamber. The flanged piston portion divides the enlarged chamber portion into first and second enlarged chambers. The second port admits fluid pressure from the isolated lower annulus to the first enlarged chamber to urge the piston to the position opening the first port. In such embodiments, the closure mechanism may include a propellant and an igniter system carried in the second enlarged chamber for generating pressure for urging the piston to the position closing the first port.

In a further aspect, the present invention provides a method for controlling the pressure in an isolated lower wellbore annulus while gravel packing. The isolated lower annulus is defined by a conduit sealably positioned within an isolated lower wellbore segment. The inventive method includes the steps of sensing the pressure within the isolated lower annulus while gravel packing, and admitting fluid from the isolated lower annulus into the conduit at one or more discrete locations along the conduit when the sensed pressure corresponds to one or more threshold pressure conditions, thereby controlling the pressure within the isolated lower annulus while gravel packing.

The pressure-sensing step of the inventive method may include sensing the pressure of the isolated lower annulus at a high-pressure location therein. In particular embodiments, the conduit is equipped with a plurality of discretely-located valves therealong, and the high-pressure location is independent of the valve locations.

In a further aspect, the present invention provides a method for reducing the risk of fracturing an isolated lower wellbore segment during beta wave progression while gravel packing using a wash pipe sealably positioned within the isolated lower wellbore segment. The inventive method includes the steps of sensing the pressure within the isolated lower wellbore segment while gravel packing, and admitting fluid from the isolated lower wellbore segment into the wash pipe at one or more discrete locations along the wash pipe when the sensed pressure corresponds to one or more threshold pressure conditions. The threshold pressure condition(s) are based upon the anticipated fracture pressure of the isolated lower wellbore segment.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
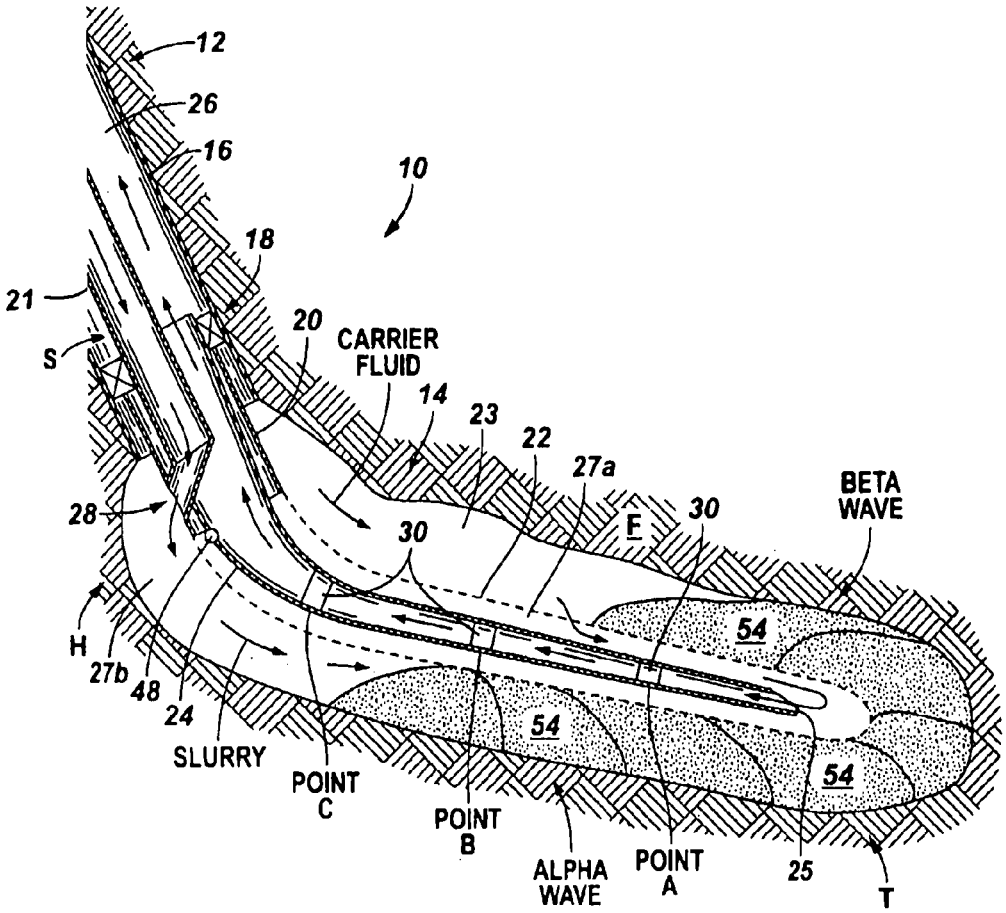
FIG. 1 is a cross-sectional schematic representation of a wellbore containing a wash pipe having a plurality of valves therein and a pressure-sensitive device carried thereby in accordance with the present invention.

Referring to FIG. 1, a wellbore 10 is shown having a vertically-deviated upper segment 12 and a substantially horizontal lower segment 14. A casing string 16 lines the upper segment 12 while the lower segment 14 is shown as an open hole, although casing 16 could be placed in the lower segment 14 as well. To the extent casing 16 covers any producing formations, casing 16 must be perforated to provide fluid communication between the formations and wellbore 10, as is well known to those of ordinary skill in the art.

A packer assembly (hereafter "packer") 18 is set generally near the lower end of upper wellbore segment 12 using the upper conduit portion 21 of a service tool S, as is well known to those of ordinary skill in the art. The packer 18 engages and seals against the casing 16, as is also well known in the art. The packer 18 has an extension 20 to which other lower completion equipment such as tubular wellbore screen 22 can attach. The screen 22 is preferably disposed adjacent a producing formation F.

The service tool upper portion 21 is initially dynamically sealed inside an upper polished bore receptacle (PBR) of the packer 18 and a lower PBR of the packer casing extension 20. Accordingly, an upper wellbore annulus 26 is formed above the packer 18 between the wall of wellbore 10 and the wall of the service tool upper portion 21.

The service tool S has a lower conduit portion commonly known as a wash pipe 24. An isolated lower wellbore annulus 23 is formed between the wall of wellbore 10 and the wall of the wash pipe 24. The screen 22 divides the isolated lower annulus 23 into inner lower annulus 27*a* and an outer lower annulus 27*b*.

Once the packer 18 is properly set by the service tool S, the service tool is set or "switched" for gravel packing, as is shown in FIG. 1. Accordingly, a crossover 28 is positioned below the point where the service tool S passes through the packer 18, as is also well known in the art. The crossover 28 allows fluids pumped through the service tool upper portion 21 to emerge into the outer lower annulus 27*b* below the packer 18. On the lower portion of the service tool, fluids entering the wash pipe 24 below the packer 18, such as through the open end 25 of the wash pipe 24 at or near the toe T of the wellbore 10, are conveyed upwardly through the wash pipe toward a heel H of wellbore 10. Upon reaching the crossover 28, the returning fluids are conveyed through or past the packer 18 and into the upper annulus 26, through which the return fluids are ultimately conveyed to the surface.

Figure 2:
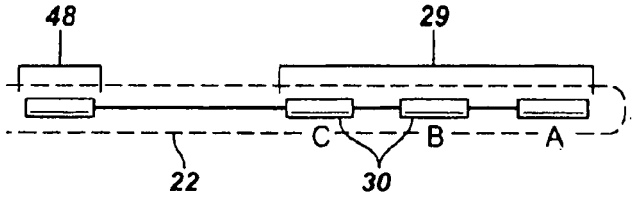
FIG. 2 is a simplified schematic showing the plurality of valves as positioned by the wash pipe independently of, but in wired communication with, the pressure-sensitive device.

At least one valve member, such as a diverter valve 30, is mounted to the wash pipe 24 below the packer 18. In the embodiment of FIG. 1, three diverter valves 30 are carried at discrete points A, B, C for selectively admitting fluid from the isolated lower annulus 23 into the wash pipe 24 at the discrete locations. FIG. 2 illustrates a simplified schematic representation of the array 29 of diverter valves 30 as positioned by the wash pipe 24 (not shown in FIG. 2) independently of, but in wired communication with, the pressure-sensitive device 48 (described below). Each diverter valve 30 preferably forms an integral part of the wall of the wash pipe 24, but other embodiments such as valve members being mounted to the wash pipe 24 such that the valve covers and seals openings (not shown) in the wash pipe are within the scope of this invention. The valves 30 may be (or may comprise) check valves, meaning they will allow fluid to flow in one direction only when in an open state, as is described further below with respect to FIGS. 6 and 7A-7B.

Figure 3A:
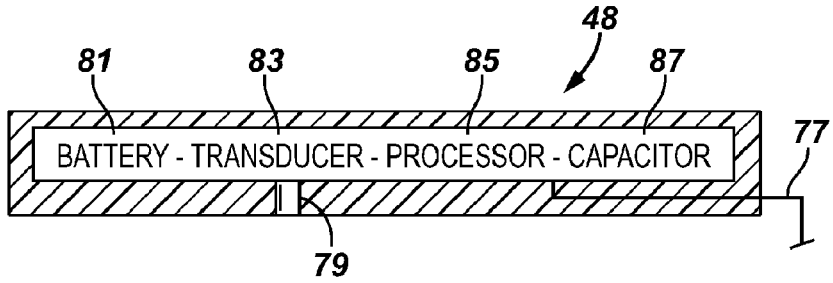
FIGS. 3A-3B are detailed cross-sectional schematic representations of the pressure-sensitive device and one of the valves of FIGS. 1-2.
Figure 3B:
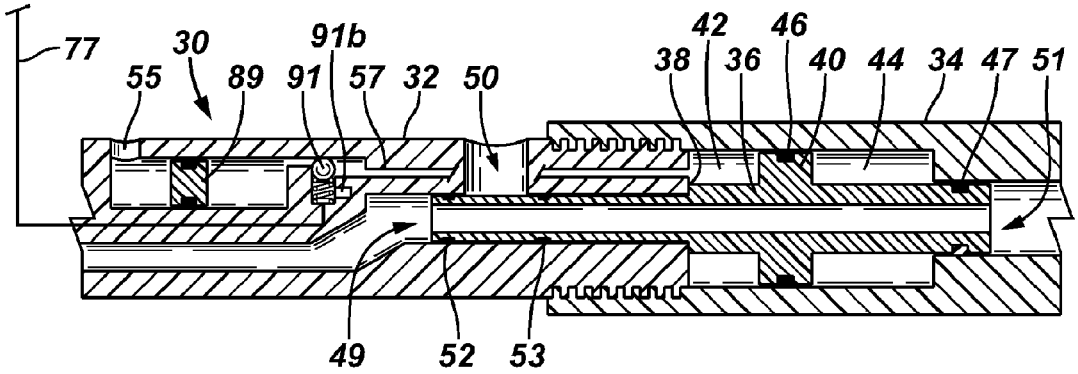

FIG. 3B shows schematically the components of one embodiment of a diverter valve 30. Each of the valves 30 includes a valve body carried within and/or forming part of the wash pipe 24. The valve body includes an upper housing 32 attached to a lower housing 34. Although FIG. 3B shows the valve housings 32, 34 attached by a threaded connection, other connectors or connection-types may be used. Additionally, the valves 30 may also employ a single-piece body, rather than the two-piece body shown.

The valve body is equipped with at least one first port 50 formed in the upper housing 32 for admitting fluid from the isolated lower annulus 23 into the wash pipe 24. A piston 36 is sealingly and slidably disposed in a chamber 38 defined by the valve body housings 32, 34. The piston 36 is movable from a position closing the first port 50 (as shown in FIG. 3B) to a position opening the first port upon actuation of the piston (described below). The piston 36 is equipped with an upper end 49 and a lower end 51, with the surface area of upper end 49 being less than the surface area of lower end 51 so that ambient wellbore fluid pressure urges the piston 36 to the closed position when the wash pipe is initially positioned in the wellbore 10.

The piston has a head or flanged portion 40 disposed for slidable movement within an enlarged portion of the valve body chamber 38. The flanged piston portion 40 divides the enlarged chamber portion into first (upper) and second (lower) enlarged chambers 42, 44. The piston flange 40 carries a seal 46 that seals against a portion of the lower housing 34 that defines the enlarged portion of the chamber 38, and thereby isolates the first enlarged chamber 42 from the second enlarged chamber 44. The piston 36 also carries a seal 47 that seals against a lower portion of lower housing 34, thereby sealing the lower end of the second (or lower) enlarged chamber 44.

The upper valve body housing 32 is further equipped with a second port 55 for admitting fluid pressure from the isolated lower annulus 23 to the first enlarged chamber 42 via an internal conduit 57 of the second port 55. In this manner, wellbore fluid pressure may be applied to urge the piston to the position opening the first port 50 (not shown in FIG. 3B, but see FIG. 8B). The upper valve housing 32 further includes a flow control device, such as a solenoid valve 91, powered by a battery 91*b* and moveable between positions opening and closing the conduit 57 of the second port 55 upon actuation of the solenoid valve 91 via a conductor 77 by a pressure-sensitive device, which will now be described.

A pressure-sensitive device 48, shown in FIGS. 1, 2 and 3A, is carried by the wash pipe 24 independently of the valves 30 for sensing the pressure within the isolated lower wellbore annulus 23 while gravel packing. The pressure-sensitive device 48 can include, but is not limited to, a rupture disk or a pressure pulse telemetry device in which an amplitude or frequency modulated pressure pulse triggers the device. A particular embodiment of the pressure-sensitive device 48 includes a battery 81, a pressure transducer 83, a processor 85, and a capacitor/transmitter 87. The battery 81 provides power for the processor 85 and the capacitor/transmitter 87. The pressure-sensitive device 48 interacts with a movable chamber divider 89, exposed to wellbore fluid pressure on its upper side, and a solenoid valve 91 of each valve 30. It will be appreciated by those skilled in the art that the solenoid valve 91 can be replaced by other flow control devices, including an explosive or burstable element.

Hydraulic communication between the pressure transducer 83 and the ambient wellbore fluid is achieved through communication port 79 of the pressure-sensitive device 48. The internal space around the pressure transducer and the communication port may be filled with a non-conductive hydraulic fluid. The port 79 may contain a filter to provide both a flow restriction against hydraulic fluid loss during deployment, and also act as a filter once wellbore fluid is in contact with the port opening.

The pressure transducer 83 converts a pressure signal (i.e., a sensed wellbore pressure) to an electrical signal and provides that electrical signal to the processor 85. The processor 85 analyzes the electrical signal to determine whether a threshold pressure condition exists in the isolated lower annulus 23, and, if so, commands the capacitor/transmitter 87 to send an actuation signal to the solenoid valve 91 (shown in FIG. 3B). When solenoid valve 91 is actuated to open the conduit 57 of the valve port 55, the lower side of chamber divider 89 is exposed to the reduced pressure (e.g., atmospheric) of first enlarged valve chamber 42. The resulting pressure differential across the chamber divider 89 moves the chamber divider towards the conduit 57, causing hydraulic fluid within the conduit 57 and the chamber 42 to bear on the piston flanged portion 40 and displace the piston 36 to an open position (see FIG. 8B). This sequence of events, from pressure sensing to piston displacement, is very rapid (e.g., within seconds or fractions of a second) and occurs on a real-time basis while gravel packing operations are being conducted.

With reference again to FIGS. 1 and 2A-2B, the pressure-sensitive device 48 is preferably carried by the wash pipe 24 such that the pressure-sensitive device is positioned adjacent the wellbore packer assembly 18 under the upper section of the screen 22. Accordingly, the device 48 is conveniently placed at or near a location of high absolute pressure within the isolated lower annulus 23, and more particularly within the inner lower annulus 27*a*. The pressure-sensitive device 48 actuates one or more diverter valves 30 by transmitting one or more actuation signals from the capacitor/transmitter 87. The one or more actuation signals may be transmitted wirelessly, e.g., using a transmitter coil (not shown), such as a radio frequency ("RF") antenna, other electromagnetic ("EM") transmitter means, inductive coupling, or by a conductor 77 extending between the controller and the valves. The conductor 77 may include one or more insulated electrical wires, optical fibers, etc., carried along the conduit that defines wash pipe 24, in a similar manner to that employed in the art of wired drill pipe (see, e.g., U.S. Pat. No. 6,641,434).

As mentioned above, the solenoid valve 91 of one of more of the valves 30 is actuated when the pressure sensed by the pressure-sensitive device 48 corresponds to one or more threshold pressure conditions. The device 48 may, e.g., be responsive to an absolute pressure of the isolated lower annulus 23 (or, more precisely, inner lower annulus 27*a*), or a pressure differential across the wall of the wash pipe 24. Pressure condition criteria to trigger a response can include proximity to a target absolute pressure—particularly local fracture pressure, the slope or rate of change of the sensed pressure with respect to time, observed trends in a pressure profile produced at the surface, or a combination of criteria being simultaneously met. Additionally, the threshold pressure conditions can be manually dictated (e.g., overriding downhole pressure condition criteria) from the surface when appropriate telemetry or communication means exists between the pressure responsive device 48 and surface. More particular explanation of a pressure pulse telemetry device can be found in U.S. Pat. No. 4,796,699, incorporated herein for all purposes.

When the pressure-sensitive member 48 commands solenoid valve 91 to its "open" state, the solenoid valve allows fluid pressure communication between the inner lower annulus 27*a* and the enlarged first chamber 42 of one or more valves 30. Such fluid pressure communication energizes the valve chamber 42 to induce sliding movement of the valve piston 36. The first port 50 can therefore provide fluid communication between the inner lower annulus 27*a* and the interior of the wash pipe 24. The piston 36 carries seals 52, 53, shown in FIG. 3B, that seal against the portion of the upper housing 32 that define chamber 38 to prevent or allow such fluid communication, depending on the position of the piston 36. The seal 53 also serves to seal the upper end of the enlarged first (upper) chamber 42.

Figure 5:
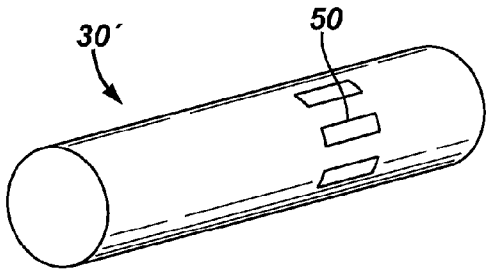
FIG. 5 is a schematic representation of a valve, suitable for use in a wash pipe, showing the orientation of fluid entry ports according to one embodiment of the present invention.
Figure 6:
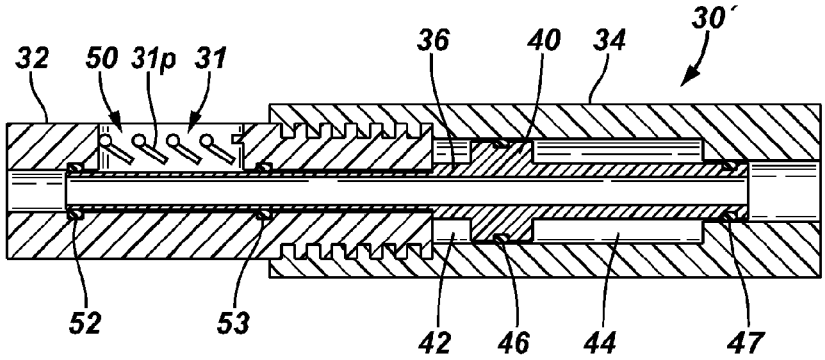
FIG. 6 is a cross-sectional schematic representation of the inventive valve employing one embodiment of a closure mechanism in accordance with the present invention.

Additional safeguards, such as a closure mechanism for selectively closing each of the first valve ports 50, may be employed. FIG. 5 shows schematically a valve embodiment 30' that employs a plurality of radially-distributed first ports 50. With reference to FIG. 6, each of the first ports 50 is equipped with a check valve in the form of a flapper valve 31 to ensure fluid flows through each first port 50 in one direction: from the isolated lower annulus 23 to the wash pipe 24. The flapper valve 31 includes a plurality of pivotally mounted plates 31*p* that are adapted for rotation from an open position (shown in FIG. 6) to a closed position (not shown) should the fluid pressure within the wash pipe 24 exceed the ambient wellbore fluid pressure within the isolated lower annulus 23 (in particular, within the inner lower annulus 27*a*) when the piston 36 is moved to an open position.

Figure 7A:
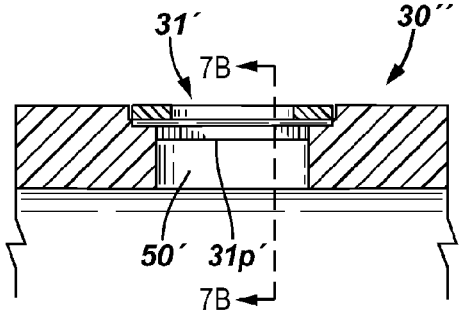
FIG. 7A is a cross-sectional schematic representation of the inventive valve employing another embodiment of a closure mechanism in accordance with the present invention.
Figure 7B:
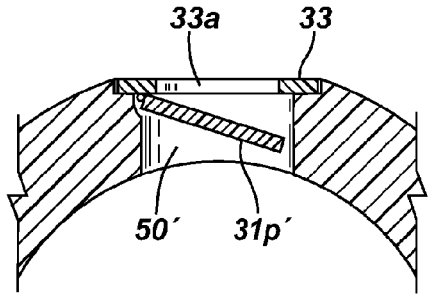
FIG. 7B is another sectional schematic representation of the inventive valve, taken along section line 7B-7B of FIG. 7A.
Figure 7C:
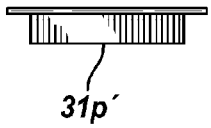
FIG. 7C is a detailed representation of a pivotal plate employed by the closure mechanism of FIG. 7A.

FIGS. 7A-7C shows a diverter valve embodiment 30" employing a flapper valve 31' having a single pivotally-mounted plate 31*p'* for closing a first port 50'. The plate 31*p'* cooperates with a cover plate 33, equipped with a central opening 33*a* (see FIG. 7B), to prevent fluid within the wash pipe 24 from exiting through the first port 50'.

It will be appreciated that the above-described diverter valve embodiments 30' and 30" have utility independent of the wash pipe 24 described herein. Thus, e.g., an open-ended conduit employing an array of such diverter valves would allow an operator to "spot" (i.e., accurately place) fluids such as Schlumberger's MudSOLVE™ treatment fluid directly after gravel packing is achieved, in a one-trip operation. This would eliminate the need to retrieve the service tool S from the wellbore 10 after gravel packing and subsequently run into the wellbore again with a fluid-spotting tool. The fluids could therefore be spotted through the open end of the conduit without risk of inadvertent release through one of the diverter valves, because fluid pressure applied in the conduit would force such diverter valves to closed positions, ensuring that the fluids exited the open end of the conduit.

Figure 8A:
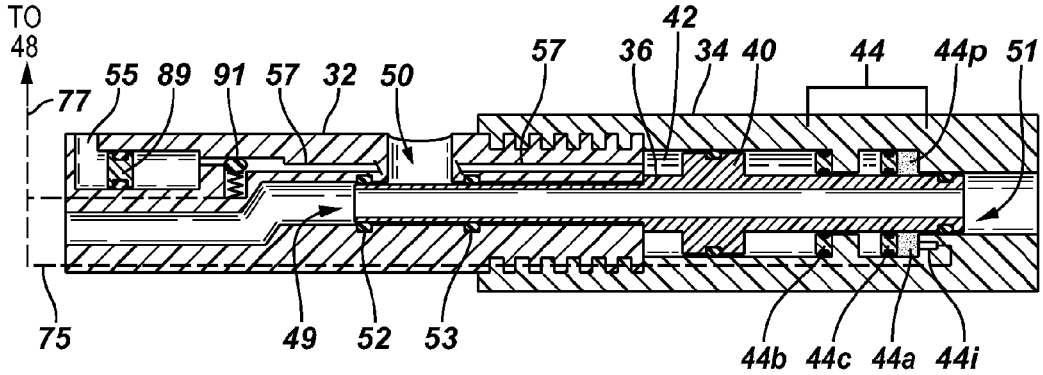
FIGS. 8A-8C are sequential, cross-sectional schematic representations of the inventive valve employing a further embodiment of a closure mechanism in accordance with the present invention.
Figure 8B:
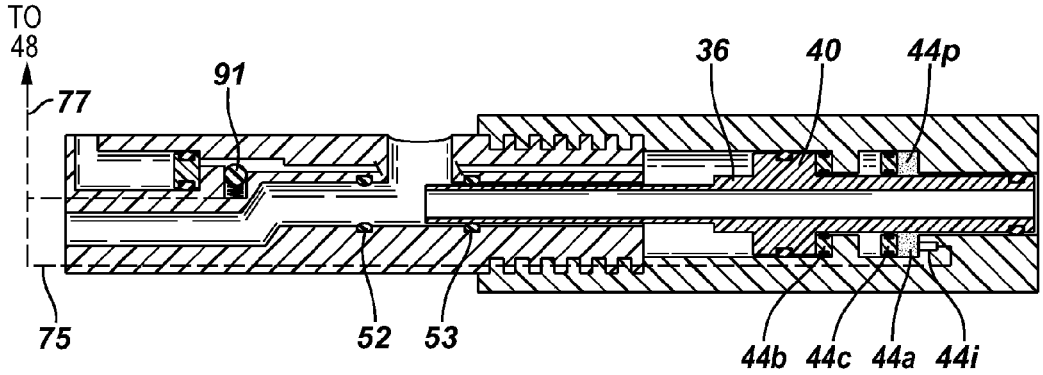
Figure 8C:
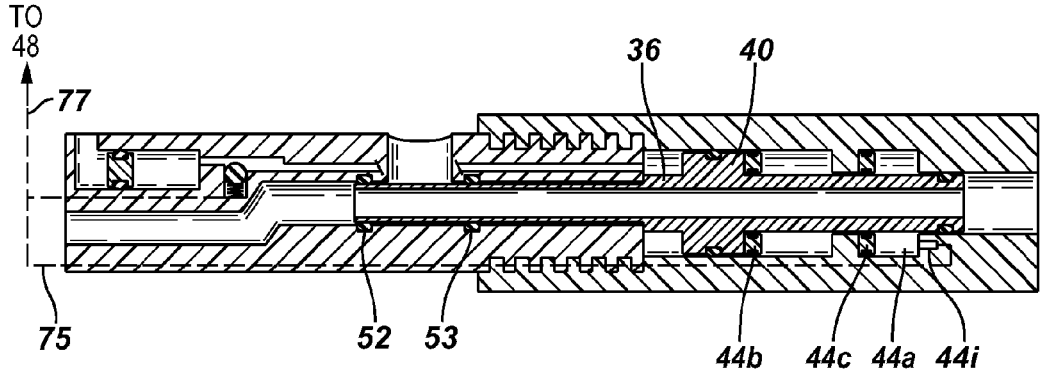

FIGS. 8A-8C are sequential, cross-sectional representations of the inventive valve employing a further embodiment of a closure mechanism in accordance with the present invention. In the first position depicted by FIG. 8A, the piston 36 is initially urged to a closed position by the ambient wellbore pressure inducing a greater force against lower piston end area 51 than upper piston end area 49. In the second position depicted by FIG. 8B, the piston 36 has been urged to an open position under actuation of the solenoid valve 91 by the pressure-sensitive device 48 (not shown in FIGS. 8A-8C). In this embodiment, the second enlarged chamber 44 of the valve body includes a burn chamber 44*a* housing a propellant 44*p* and an igniter system 44*i* for generating pressure for urging the piston 36 from the position opening the first port 50 (see FIG. 8B) to the position closing the first port, as depicted by FIG. 8C. The igniter 44*i* is actuated by a signal from the capacitor/transmitter 87 of the pressure-sensitive device 48 via a conductor 75. The actuation signal is transmitted upon the sensing of a particular mud-pulse signal (generated, e.g., via conventional mud-pulse telemetry means) by the pressure transducer 83 of the pressure sensitive device 48. The propellant may include, e.g., a solid fuel pack having materials that generate pressure as they ignite and burn. The second enlarged chamber 44 further includes a pair of movable chamber dividers 44*b*, 44*c* that isolate a volume 45 of hydraulic fluid therebetween so as to enable the pressure generated in the burn chamber 44*a* to be transferred to the piston flange 40 while retaining the combustion products within the burn chamber. When the piston 36 is thereby returned to the closed position, fluid pumped downwardly though the wash pipe 24 is forced to exit the open end 25 thereof (assuming the crossover 28 is closed or removed).

A gravel packing operation utilizing the present invention will now be described. The packing operation begins by placing lower completion equipment including the packer 18, packer extension 20, and screen 22 within the wellbore 10 using the service tool S to run the entire assembly into the wellbore. The initial steps include setting the packer 18 within the casing 16 and "releasing" the service tool S from the packer, thereby leaving the assembly consisting of the packer 18, packer extension 20, and screen 22 permanently located with respect to the casing 16. The service tool S is then "switched" to gravel pack position such that a crossover 28, diverter valves 30, and the open lower end 25 of the wash pipe 24 are properly positioned within the isolated lower annulus 23. Because the chamber 38 of each valve 30 is initially set at atmospheric pressure, and because the surface area of the lower end 51 of each valve piston 36 is greater than the surface area of the upper end 49 of the piston 36, each piston 36 is hydraulically biased to its upward position as the service tool S is lowered into position within the wellbore 10 and casing 16. This ensures that port 50 remains closed until purposely opened (or, equivalently, covering and sealing holes in the wash pipe 24).

Gravel slurry is pumped through the service tool S into the wash pipe 24 and ejected via the crossover 28 into the isolated outer lower annulus 27*b*. The gravel slurry may be of various concentrations of particulates and the carrier fluid can be of various viscosities. In substantially horizontal wellbores, and particularly with a low-viscosity carrier fluid such as water, the placement or deposition of gravel generally occurs in two stages. During the initial stage, known as the "alpha wave", the gravel precipitates as it travels downwardly to form a continuous succession of dunes 54 (see FIG. 1). Depending on factors such as slurry velocity, slurry viscosity, sand concentration, and the volume of the isolated lower annulus 23, each dune 54 will grow in height until the fluid velocity passing over the top of dune 54 is sufficient to erode the gravel and deposit it on the downstream side of dune 54. The process of building up a dune 54 to a sustainable height and deposition on the downstream dune side to initiate the build-up of each successive dune 54 is repeated as the alpha wave progresses to the toe T of wellbore 10.

As the alpha wave travels to the toe T and the gravel settles out, the carrier fluid preferably travels in outer lower annulus 27*b* or passes through screen 22 and enters inner lower annulus 27*a* and continues to the toe where it is picked up by wash pipe 24 via open end 25, and then conveyed to the surface. A proper layer of "filter cake," or "mud cake" (a relatively thin layer of drilling fluid material lining wellbore 10) helps prevent excess leak-off to the formation.

When the alpha wave reaches the toe T of the wellbore 10, the gravel begins to backfill the portion of the lower annulus 23 left unfilled by the alpha wave. This is the second stage of the gravel pack and is referred to as the "beta wave." As the beta wave progresses toward the heel H (see FIG. 1) of the wellbore 10 and gravel is deposited, the carrier fluid passes through screen 22 and enters inner lower annulus 27*a*. So long as the diverter valves 30 remain closed, the carrier fluid must make its way to the open end 25 near the toe T to be returned to the surface. As the beta wave gets farther and farther from the toe T, the carrier fluid entering the inner lower annulus 27*a* must travel farther and farther to reach the open end 25 of the wash pipe 24. The flowpath to the toe through the outer lower annulus 27*b* is effectively blocked because of the deposited gravel. As is common in fluid flow, the pressure in wellbore 10 tends to increase due to the increased resistance resulting from the longer and more restricted flowpath.

Figure 4A:
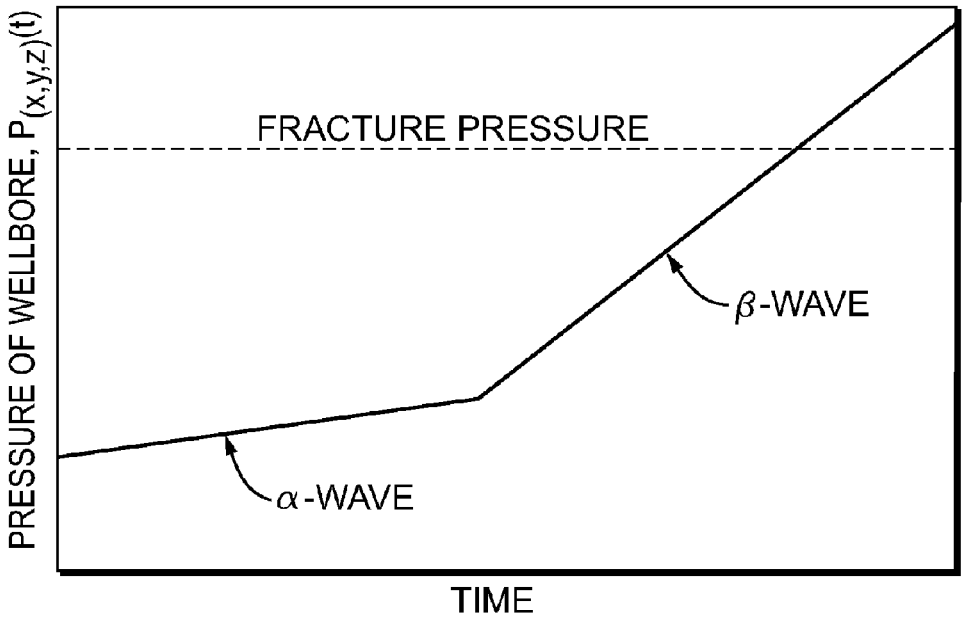
FIG. 4A is a graph of wellbore pressure as a function of time in a conventional gravel pack operation in a horizontal wellbore segment.

FIG. 4A shows a typical plot of expected pressure in wellbore 10 with a prior art wash pipe having no diverter valves therein. For reference, FIG. 4A also shows the limiting pressure or fracture pressure of the formation, above which damage to the formation may occur. Pumping operations are generally halted just below fracture pressure. This early termination of pumping results in an incomplete gravel pack.

Figure 4B:
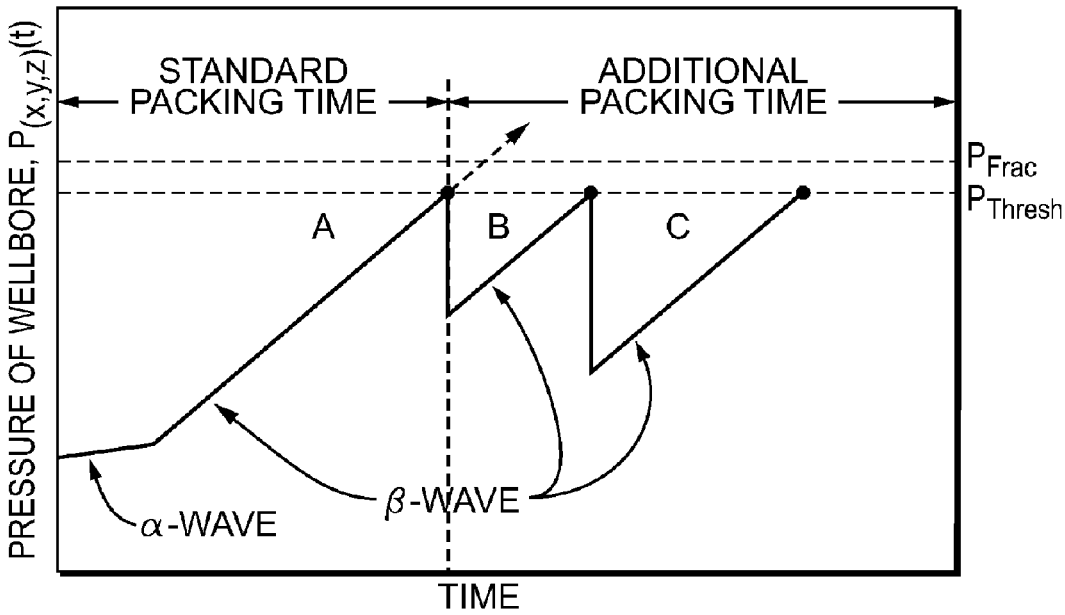
FIG. 4B is a graph of wellbore pressure as a function of time in a gravel pack operation in a horizontal wellbore segment in which the wash pipe of FIG. 1 is used.

FIG. 4B shows a typical pressure profile expected with the use of diverter valves 30 and a pressure-sensitive device 48 in accordance with the present invention. The valves 30 are strategically placed along the lower length of the wash pipe 24. Proper placement of the valves 30 and the determination of threshold pressure conditions for pressure-sensitive device 48 vary according to the pressure environment of a particular wellbore 10. This pressure environment can be modeled or simulated using known computational techniques for estimating wellbore pressure. Using such techniques allows engineering estimates for optimal placement of valves 30 and selection of an appropriate pressure-sensitive device 48.

FIGS. 1, 2, and 4B show the locations of three diverter valves 30 and the pressure plot corresponding to their use with a pressure-sensitive device 48 designed for responding to the respective pressure threshold conditions associated with the three valves. The respective valve locations are designated by points A, B, and C depicted on FIGS. 1, 2, and 4B. In operation, after the alpha wave reaches the toe T and the beta wave reaches valve point A, the wellbore pressure—which has been sensed by the pressure-sensitive device 48 throughout gravel packing—is elevated to a magnitude just sufficient to correspond to a threshold pressure condition $P_{Thresh}$ of the pressure-sensitive device 48. This triggers the transmission of an actuation signal from the pressure-sensitive device 48 to the valve 30 positioned at point A, thereby exposing the enlarged first (upper) chamber 42 of that valve 30 to the pressure in inner lower annulus 27*a*. This pressure exceeds the atmospheric pressure in the second (lower)

enlarged chamber 44, causing the piston 36 of that valve to move downwardly, exposing the first port 50 to the inner lower annulus 27*a*. With the first port 50 in its "open" state, the carrier fluid no longer must travel to the open end 25 of the wash pipe 24 to return to the surface. Instead, the carrier fluid enters the wash pipe 24 through the first port 50 at valve point A. This allows the wellbore pressure to drop, as shown in the vertical, linear portion of the pressure profile adjacent point A in FIG. 4B.

As the beta wave continues up wellbore 10 toward the heel H, the annulus pressure will increase as the flow path again lengthens. However, upon passing point B, the pressure will again be sufficient to correspond to the threshold pressure condition $P_{Thresh}$ of the pressure-sensitive device 48. As before, this results in actuation of the diverter valve 30 at point B by the pressure-sensitive device. That creates a flow path from inner lower annulus 27*a* into the wash pipe 24 at point B, thus relieving the wellbore pressure again. This process is repeated for each additional diverter valve 30, as illustrated again at point C.

FIG. 4B also shows the relative time a standard gravel pack (without diverter valves 30 or pressure-sensitive device 48) will be allowed to run until halted at the pressure $P_c$ anticipated at point C, just below the fracture pressure. It also shows the additional relative packing time permitted when diverter valves 30 are used according to the present invention. The term "relative" time is used to indicate the controlling factor is really wellbore versus fracture pressure since time van be extended or shortened by varying other parameters. However, by controlling pressure, extended relative pumping times can be gained. Additional time is gained because the open diverter valves 30 reduce the resistance to the return of carrier fluids to the surface due to shortened flow paths. If diverter valves 30 are properly chosen, the gravel pack operation can be run until the screens are completely covered, while never exceeding the fracture pressure. Although the diverter valves 30 are described as being employed with a pressure-sensitive device 48 having a plurality of respective threshold (actuating) pressure conditions, it will be appreciated by those having ordinary skill in the art that the pressure-sensitive device may be designed to open all of the diverter valves carried by the wash pipe upon the presence of a single threshold pressure condition within the isolated lower wellbore annulus 23.

It will be further appreciated that the rate of fluid return upwardly through the wash pipe 24 can be regulated using a choke, as is well known in the art. Such use of a choke gives an operator an additional means of control over the actuation of the diverter valve(s) 30 by the pressure-sensitive device 48 by allowing the operator to selectively increase the wellbore pressure to the actuation level, should the operator so choose.

It will be still further appreciated that the present invention admits to a number of advantages, including but not limited to: wellbore pressure control without the need for monitoring/locating the beta wave; tolerance to unexpected events such as high leak-off rate to the formation and/or drop in proppant concentration; freedom of diverter valve locations; enhanced reliability by interconnection of diverter valves; adaptive to multiple pressure-sensing locations (e.g., in annulus above packer); easily retrievable; simplified control/actuation logic with reduced risk of false actuation; and not dependent on the use of a polished bore receptacle (PBR) in the screen.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

The term "comprising" within the claims is intended to mean "including at least" such that the recited listing of elements in a claim are an open set or group. Similarly, the terms "containing," "having," and "including" are all intended to mean an open set or group of elements. "A," "an" and other singular terms are intended to include the plural forms thereof unless specifically excluded.

What is claimed is:

1. An apparatus for controlling the pressure in an isolated lower wellbore annulus while gravel packing, the isolated lower wellbore annulus being defined by a conduit sealably positioned within an isolated lower wellbore segment, the apparatus comprising:

a plurality of valves carried by the conduit at discrete locations for selectively admitting fluid from the isolated lower annulus into the conduit at the discrete locations; and a pressure-sensitive device carried by the conduit independently of the valves for sensing the pressure within the isolated lower annulus while gravel packing, and for actuating one or more of the valves when the sensed pressure corresponds to one or more threshold pressure conditions so as to admit fluid from the isolated lower annulus into the conduit and thereby control the pressure within the isolated lower annulus while gravel packing, wherein each of the valves comprises:

a valve body carried within the conduit, the valve body being equipped with a first port for admitting fluid from the isolated lower annulus to the conduit; and a piston slidably disposed in a chamber of the valve body and movable from a position closing the first port to a position opening the first port upon actuation of the piston by the pressure-sensitive device, each valve further comprising a check valve carried in the first port to ensure fluid flows through the first port in one direction: from the isolated lower annulus to the conduit, the check valve comprising a flapper valve having one or more pivotally mounted plates.

2. The apparatus of claim 1, wherein the conduit comprises a wash pipe sealably positioned within a wellbore packer assembly having a tubular wellbore screen depending therefrom, the wash pipe being positioned within the screen such that the screen divides the lower wellbore annulus into an inner lower annulus and an outer lower annulus.

3. The apparatus of claim 2, wherein the wash pipe comprises a crossover portion for delivering fluid to the outer lower annulus.

4. The apparatus of claim 2, wherein the pressure-sensitive device is carried by the wash pipe such that the pressure-sensitive device is positioned adjacent the wellbore packer assembly.

5. The apparatus of claim 1, wherein:

the piston has a flanged portion disposed for slidable movement within an enlarged portion of the valve body chamber, the flanged piston portion dividing the enlarged chamber portion into first and second enlarged chambers;

the valve body is equipped with a second port for admitting fluid pressure from the isolated lower annulus to the first enlarged chamber, urging the piston to the position opening the first port; and each of the valves further comprises a flow control device moveable between positions opening and closing the second port upon actuation of the flow control device by the pressure-sensitive device.

6. The apparatus of claim 5, wherein the second enlarged chamber comprises a burn chamber housing a propellant and an igniter system for generating pressure for urging the piston to the position closing the first port.

7. The apparatus of claim 1, wherein the pressure-sensitive device comprises a pressure transducer and a controller.

8. The apparatus of claim 7, wherein the pressure-sensitive device actuates one or more valves by transmitting one or more actuation signals from the controller.

9. The apparatus of claim 8, wherein the one or more actuation signals are transmitted wirelessly.

10. The apparatus of claim 8, wherein the one or more actuation signals are transmitted by a conductor extending between the controller and the valves.

11. The apparatus of claim 10, wherein the conductor comprises one or more insulated wires carried along the conduit.

12. A valve for use in a conduit disposed in a wellbore while gravel packing an isolated lower annulus of the wellbore, comprising:

a valve body adapted for carriage within the conduit and having a first port for admitting wellbore fluid from the isolated lower annulus into the conduit, a second port for admitting fluid pressure from the isolated lower annulus into the valve body, and a chamber;

a piston slidably disposed in the valve body chamber and movable between positions closing and opening the first port while maintaining the conduit in an open flow position;

the second port admitting fluid pressure from the isolated lower annulus to the valve body chamber to urge the piston to the position opening the first port; and a closure mechanism for closing the first port.

13. The valve of claim 12, further comprising a flow control device selectively moveable between positions opening and closing the second port.

14. The valve of claim 12, wherein the piston has a flanged portion disposed for slidable movement within an enlarged portion of the valve body chamber, the flanged piston portion dividing the enlarged chamber portion into first and second enlarged chambers and the second port admitting fluid pressure from the isolated lower annulus to the first enlarged chamber to urge the piston to the position opening the first port.

15. The apparatus of claim 14, wherein the closure mechanism comprises a propellant and an igniter system carried in the second enlarged chamber for generating pressure for urging the piston to the position closing the first port.

16. The valve of claim 12, wherein the closure mechanism comprises a check valve carried in the first port to close the first port against fluid flow from the conduit to the isolated lower annulus.

17. A valve for use in a conduit disposed in a wellbore while gravel packing an isolated lower annulus of the wellbore, comprising:

a valve body adapted for carriage within the conduit and having a first port for admitting wellbore fluid from the isolated lower annulus into the conduit, a second port for admitting fluid pressure from the isolated lower annulus into the valve body, and a chamber;

a piston slidably disposed in the valve body chamber and movable between positions closing and opening the first port;

the second port admitting fluid pressure from the isolated lower annulus to the valve body chamber to urge the piston to the position opening the first port; and a closure mechanism for closing the first port, wherein the closure mechanism comprises a check valve carried in the first port to close the first port against fluid flow from the conduit to the isolated lower annulus, further wherein the check valve comprises a flapper valve having one or more pivotally mounted plates.

* * * * *